United States Patent [19]

Bechtold

[11] Patent Number: 4,931,772

[45] Date of Patent: Jun. 5, 1990

[54] SAFETY MONITOR

[75] Inventor: Guy L. Bechtold, Lancaster, Pa.

[73] Assignee: The Heil Company, Milwaukee, Wis.

[21] Appl. No.: 797,855

[22] Filed: Nov. 14, 1985

[51] Int. Cl.[5] ..... G08B 23/00

[52] U.S. Cl. ..... 340/573; 340/539; 340/686

[58] Field of Search ..... 340/573, 539, 540, 529, 340/686, 691

[56] References Cited

U.S. PATENT DOCUMENTS

| | | | |
|---|---|---|---|
| 3,588,858 | 6/1971 | Denuth | 340/573 |
| 3,866,204 | 2/1975 | Barkley | 340/573 |
| 4,359,723 | 11/1982 | Cohen | 340/573 |
| 4,468,656 | 8/1984 | Clifford et al. | 340/573 |

*Primary Examiner*—Joseph A. Orsino
*Assistant Examiner*—Jeffery A. Hofsass
*Attorney, Agent, or Firm*—Bayard H. Michael

[57] ABSTRACT

A radio frequency transmitter is adapted to be worn by a worker in a confined space. The transmitter includes a manual switch and a mercury switch which, when tilted by reason of the worker getting out of his normal work position, closes to cause the transmitter to emit a signal which is received by a receiver positioned outside of the confined space. The receiver closes a switch to put the coil of a relay across a power supply. The relay closes two switches, one being an alarm switch which causes energization of a strobe light and a siren; the other establishes a holding circuit by-passing the receiver actuated switch. The holding circuit includes an interrupt switch to turn off the alarm. There is a time delay in the relay circuit to avoid false alarms. Once the alarm is sounded, termination of the radio frequency signal alone will not stop the alarm; the switch in the holding circuit must also be opened.

2 Claims, 1 Drawing Sheet

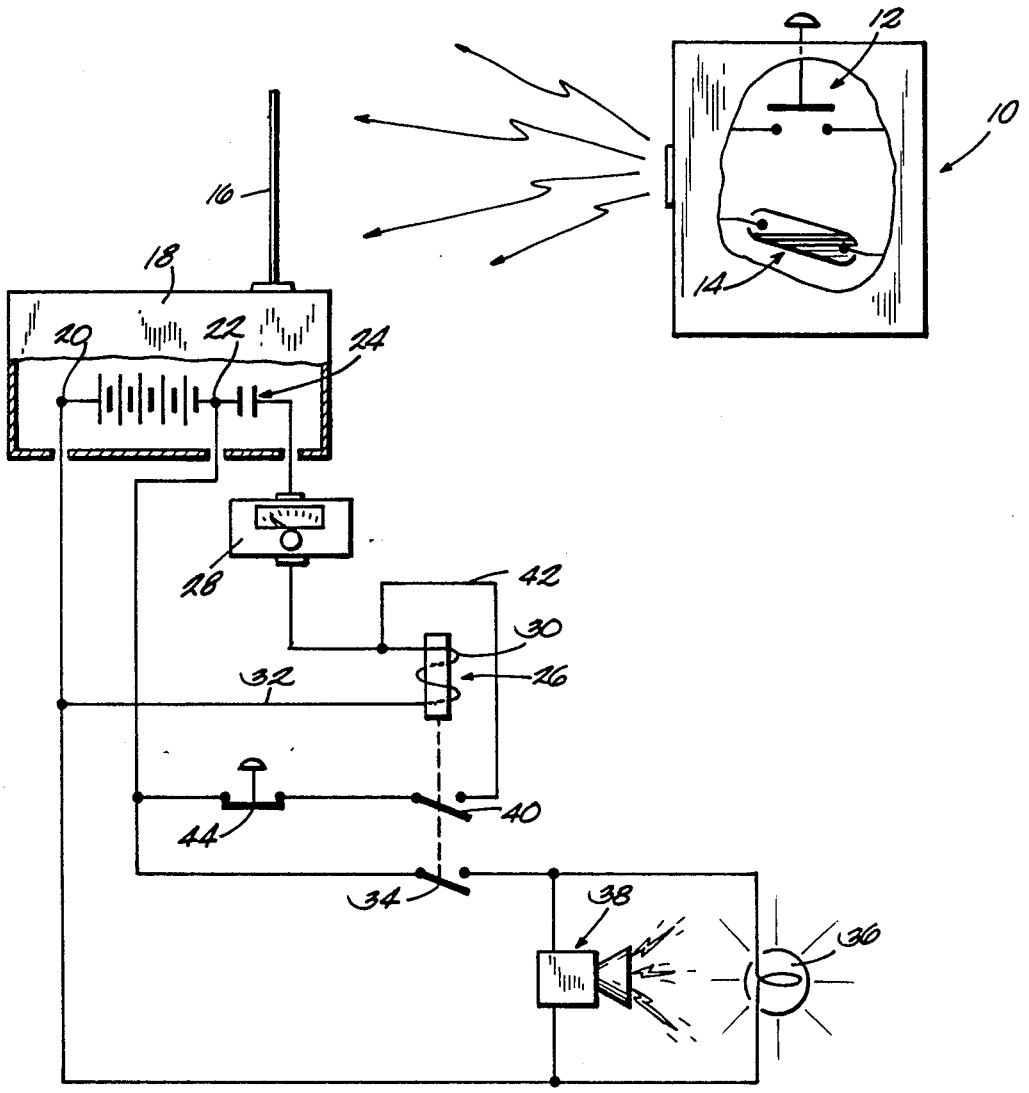
12
10
16
18
20
22
24
14
28
42
30
26
32
44
40
34
38
36

SAFETY MONITOR

BACKGROUND OF THE INVENTION

There are various industrial and agricultural jobs requiring a person to enter a confined space which may contain dust or fumes which can reach dangerous levels or in which the worker is out-of-sight and would be in serious trouble if struck by heart attack, accident or the like. To safeguard such workers, the usual procedure is to have a second worker positioned outside the space to observe the first worker while the tasks are performed. Sometimes a safety rope is secured to the worker for use in dragging the worker out should he be overcome by fumes, thus preventing the exposure of the second worker to the same fumes. In most cases, the worker is simply turned loose to do his job and everyone hopes for the best.

This invention is related to monitoring the condition of the worker without requiring a second worker to stand watch.

SUMMARY OF THE INVENTION

This invention provides apparatus for monitoring the physical condition of a worker and includes a position responsive device to be worn by a worker and operative to transmit a signal in response to a position indicative of the worker being disabled. A device responsive to the signal produces an alarm and a holding circuit continues the operation of the alarm even if the transmitted signal terminates. Provision is made for disabling the alarm by a positive action.

The invention provides an adjustable time delay in responding to the signal to thereby avoid false alarms.

The invention further contemplates that the position responsive device is a mercury switch and will respond to the worker's body deviating substantially from the normal upright position.

The invention also contemplates that the signal transmitter is a radio frequency transmitter which is energized either by the mercury switch or by a manual switch, thus enabling the worker to call for help. A signal responsive arrangement closes an alarm circuit and a holding circuit. The signal responsive arrangement is a radio frequency receiver, a relay and a power supply along with a switch operated by the receiver to connect the relay to the power supply to close the alarm and holding circuits. The alarm circuit includes a siren and a strobe light. The holding circuit, which continues the response even if the transmitter signal is terminated, is a parallel circuit including the relay so that opening of the receiver switch alone will not terminate energization of the relay...a normally closed, push-to-open switch in the holding circuit must also be opened.

BRIEF DESCRIPTION OF THE DRAWINGS

The single figure of drawings is a schematic wiring diagram and representation of the components of this device.

DETAILED DESCRIPTION OF THE DRAWINGS

The worker whose activities are to be monitored is provided with a position responsive device which will transmit a radio frequency signal in response to a position indicative of the worker being in trouble. This device is a transmitter 10 which includes a manually operable switch 12 and a mercury switch 14, both being shown within the square representing the transmitter. It will be appreciated the manual switch is operable from outside the transmitter housing while the mercury switch would be enclosed within the housing. The mercury switch is mounted so as to require any desired deviation of the body from vertical before closing the contacts; this may be 45° or it could be 90° indicative of a fallen worker.

The transmitter will be energized, to transmit a radio frequency signal when either manual switch 12 or the position responsive switch 14 is closed. Even if the worker is in an enclosed tank having only a manhole entry, enough radio signal will escape through the manhole to actuate the receiver when the signal is picked up by the antenna 16 of a receiver 18 positioned adjacent the manhole. The receiver includes a DC power supply across terminals 20, 22. The receiver 18 comprises a portion of the means responsive to the transmitted signal to produce an alarm.

The receiver actuates power switch 24 when the signal is received. Switch 24 applies voltage to relay 26 through the time delay 28. The time delay is adjustable and may typically be in the neighborhood of 4 seconds, but can be any desired value. Thus, so long as the transmitted signal is received by the receiver, power switch 24 will remain closed and at the end of the adjusted time delay the coil 30 of relay 26 is energized. The other end of the coil is connected to the other side of the DC supply through lead 32.

Energization of the relay will close alarm switch 34 to complete the circuit to the strobe light 36 and the electronic siren 38, both of which now go into operation. Actuation of the relay 26 also closes holding switch 40 and this completes a holding circuit connecting the relay coil 30 to one side of the battery through lead 42, switch 40 and disabling switch 44 while the other side of the coil is connected to the other side of the battery through lead 32. This holding circuit is in parallel with the power switch 24 actuated by the receiver. Thus, if the transmitter 10 ceases to transmit and switch 24 opens the relay 26 will continue to be actuated and switches 40, 34 will remain closed and the strobe light 36 and the siren 38 will continue to operate. To terminate operation of the strobe and siren both the power switch 24 and the disabling switch 44 must be open. The normally closed disabling switch 44 is opened by momentarily depressing the switch. This breaks the holding circuit to the relay and, assuming power switch 24 is open, switches 34, 40 will open.

The receiver and the relay, strobe and siren may all be operated on an AC power supply if desired.

With this arrangement, a worker can enter a confined space with greater confidence. The worker is assured that his co-workers outside the space will be notified rapidly in case of accident.

I claim:

1. Apparatus for monitoring the condition of a worker, comprising, radio frequency transmitter having a battery, a position responsive switch adapted to be worn by a worker and responsive to a position indicative of the worker being disabled to cause said transmitter to transmit a signal, a radio frequency receiver including a power supply, a relay, an alarm switch and a holding switch operated by said relay, a power switch operated by said received in response to said signal to connect said relay to said power supply to close said alarm switch and said holding switch, alarm means operated when said alarm switch is closed, a holding circuit including said holding switch, said relay and said power supply, a termination switch operative to break said holding circuit, said relay including a coil which is connected to said power supply through said power switch and through both said holding switch and said termination switch.

2. Apparatus according to claim 1 in which said alarm means includes an audible alarm and a strobe light.

* * * * *